United States Patent [19]

Huang et al.

[11] Patent Number: 5,049,163

[45] Date of Patent: Sep. 17, 1991

[54] PROCESS FOR REDUCING SULPHUE DIOXIDE EMISSION FROM BURNING COAL CONTAINING SULPHUR

[75] Inventors: Zhongcheng Huang; Peilan Wang; Xiaoxu Lei, all of Beijing, China

[73] Assignee: Briquetting Research and Design Institute, Beijing Graduate School of China University of Mining and Technology, Beijing, China

[21] Appl. No.: 456,303

[22] Filed: Dec. 26, 1989

[30] Foreign Application Priority Data

Dec. 28, 1988 [CN] China ..... 88108858.7

[51] Int. Cl.[5] ..... C10L 5/12; C10L 5/38; C10L 9/10

[52] U.S. Cl. ..... 44/622; 44/550; 44/596; 44/608

[58] Field of Search ..... 44/622, 11, 16 R, 16 C, 44/14, 550, 596, 608

[56] References Cited

U.S. PATENT DOCUMENTS

| | | | |
|---|---|---|---|
| 2,012,374 | 8/1935 | Bosch | 44/550 |
| 3,527,580 | 9/1970 | Bonlie | 44/11 |
| 3,689,234 | 9/1972 | Onozawa | 44/17 |
| 4,093,451 | 6/1978 | Cass et al. | 75/43 |
| 4,226,601 | 10/1980 | Smith | 44/550 |
| 4,253,603 | 3/1981 | Johnson | 236/86 |
| 4,274,836 | 6/1981 | Ban et al. | 44/604 |
| 4,322,218 | 3/1982 | Nozaki | 44/604 |
| 4,420,404 | 12/1983 | Coate et al. | 210/808 |
| 4,519,807 | 3/1985 | Nishino et al. | 44/604 |
| 4,529,407 | 7/1985 | Johnston et al. | 44/596 |
| 4,787,913 | 11/1988 | Goleczka et al. | 44/599 |

*Primary Examiner*—Margaret B. Medley
*Attorney, Agent, or Firm*—Charles Berman

[57] ABSTRACT

This invention discloses a process for reducing sulphur dioxide emission from burning coal containing sulphur. In the disclosed process, pulverized combustible materials, such as coal, wood flour, combustible plant, charcoal, etc., and a sulphur trapping agent composition are mixed homogeneously to form an admixture which is ground to powder with dimension from about 30 mesh to about 60 mesh. With an improved roll briquetter of the present invention, briquettes with a microporous surface layer of said admixture powder can be prepared. In such briquettes, the atomic ratio of calcium in the sulphur trapping agent composition to sulphur in the pulverized coal is within the range of from about 1.0 to about 2.0. Microporous pellets of said admixture having opening-porosity are also prepared with conventional roll briquetter. The diameter of the prepared pellets is within the range from about 8 mm to about 20 mm. A layer of said pellets covers the surface of pulverized coal in a burner for combustion. In the burner, the atomic ratio of calcium in the sulphur trapping agent composition pellets to sulphur in the coal is within the range from about 1.0 to about 2.0.

16 Claims, 1 Drawing Sheet

PROCESS FOR REDUCING SULPHUE DIOXIDE EMISSION FROM BURNING COAL CONTAINING SULPHUR

This invention relates to a process for reducing sulphur dioxide emission from burning coal containing sulphur.

BACKGROUND OF THIS INVENTION

Coal is one of the main energy resources for human kind. As the petroleum reserve is getting less and less, the proportion of coal in the constitution of energy will be getting larger and larger. Unfortunately, much of the coal found in the world contains sulphur in varying quantities. When such sulphur-containing coal is burned, sulphur dioxide is produced and emitted into the atmosphere, which severely pollutes the atmosphere of the globe. Therefore it is very important to device a process for "clean burning" of sulphur-containing coal to reduce the pollution of the atmosphere by smoke when sulphur-containing coal is burned.

U.S. Pat. No. 4,226,601 disclosed a "Process for reducing sulphur contaminant emissions from burning coal or lignite that contains sulphur". In the disclosed process, the coal or lignite that contains sulphur is first pulverized then directly mixed with a finely divided inorganic material for burning. The inorganic material can be at least one of the oxides, hydroxides or carbonates of sodium, potassium, calcium or barium or it can be dolomite. Another way is to form the mixture of coal or lignite and the inorganic material into briquettes or pellets in order to reduce sulphur dioxide contained in the smoke, the mixture could be conveniently shipped, stored and used in conventional combustion equipment.

U.S. Pat. No. 4,322,218 discloses a process in the title of "$SO_2$ capture-coal combustion". In the disclosed process, a coal, a calcium-containing material and a additive are blended homogeneously prior to their introduction into the burner; or coal, calcium containing meterial and other additive are put simultaneously into the burner.

The disadvantages of the above disclosed processes are: only a sulphur trapping agent composition of calcium series is simply blended with sulphur-containing coal for reducing $SO_2$ emission from burning sulphur-containing coal. As the specific gravity of the calcium-containing sulphur trapping agent composition is much larger than that of coal or lignite, when a certain amount of said composition is added to the coal, the ratios of the volume and total surface area of said composition will be much smaller than that of coal or lignite. When sulphur-containing coal or lignite is burned, the sulphur dioxide formed has less opportunity to contact the calcium-containing sulphur trapping agent. As a result, the conversion rate of $SO_2$ to $CaSO_3$ and/or $CaSO_4$ is low, $SO_2$ content in smoke is still high. Therefore, the above-disclosed processes can not reduce the smoke pollution of atmosphere effectively.

To overcome the demerits of the prior arts, the object of this invention is to provide a process for reducing the $SO_2$ emission from burning sulphur-containing coal which includes anthracite coal, bituminous coal, subbituminous coal and lignite effectively. Another object of this invention is to increase the contacting opportunity between $SO_2$ and calcium-containing sulphur trapping agent composition in order to raise the coefficient of utilization of the composition itself and reduce the $SO_2$ content in smoke effectively when a small amount of the sulphur trapping agent composition is used.

The sulphur trapping agent composition in the present invention comprises conventional calcium-containing compounds such as calcium oxide, calcium hydroxide or calcium carbonate, and at least one compound selected from the group consisting of the inorganic compounds of potassium, sodium, barium, manganese, tin and ferro. In said composition, a calcium-containing compound is more than 90 percent of the total weight, and the other material is less than 10 percent of the total weight. It is well-known by the person skilled in this field that the inorganic compounds of potassium, sodium, barium, manganese, tin and ferro mainly act as a catalyst in sulphur trapping reactions.

The advantages of the present invention are as follows:

1) Further reducing the $SO_2$ content in smoke from burning sulphur-containing coal:

By applying the technology of the present invention, the $SO_2$ content in the smoke is about 20% to about 40% lower than that by adopting the conventional technology.

2) Reducing the consumption of inorganic sulphur trapping agent:

The atomic ratio of calcium in the composition to sulphur in coal present in is from about 1.0 to about 2.0 in the present invention in comparison with that the atomic ratio of calcium to sulphur is larger than 2.0 in the prior arts in order to obtain the commercial effects of the sulphur trapping according to the present invention.

SUMMARY OF THE INVENTION

This invention relates to a process for reducing sulphur dioxide emission from burning sulphur-containing coal which includes anthracite coal, bituminous coal, subbituminous coal and lignite, comprising:

grinding an admixture of a sulphur trapping agent composition in an amount of from about 99 to about 50 weight percent, preferably from about 95 to about 70 weight percent, with a pulverized combustible material to a powder of about 30 to about 60 mesh in size;

preparing a briquette wrapped up in a microporous surface layer of said admixture powder by means of an improved roll briquetter, the atomic ratio of calcium in the sulphur trapping agent composition to sulphur in the coal being from about 1.0 to about 2.0; and alternatively.

forming microporous pellets of said admixture having opening-porosity with a diameter of from about 8 mm to about 20 mm by means of a conventional roll briquetter; and, putting a layer of said microporous pellets of said admixture having opening-porosity upon the surface layer of a coal in a burner for combustion. In said burner, the atomic ratio of calcium in the layer of sulphur trapping agent pellets to sulphur in the coal layer is from about 1.0 to 2.0.

The combustible material in the above-mentioned admixture includes coal, wood flour, combustible plant, charcoal or combustible synthetic materials or their wastes thereof.

The process of producing the briquette of the present invention comprises that during the shaping of the briquette, the admixture powder of combustible material and sulphur trapping agent composition and pulverized coal are added separately, and that said admixture powder is added to ball sockets (4) of the improved roll briquetter before the pulverized coal.

The improved roll briquetter of the present invention comprises that at least one hopper (1) for the admixture powder of sulphur trapping agent composition and combustible material should be installed at two sides of hopper (2) for the pulverized coal in common roll briquetter, and that a valve (7) should be installed above the hopper (1) for controlling the quantity of said admixture powder added to ball sockets (4).

An improved layer-burnt burner comprises that at least one hopper (9) for the microporous egg-like sulphur trapping agent pellets having opening-porosity should be installed at the head of hopper (8) for pulverized coal in common layer-burnt burner, and that a valve (10) should be installed on hopper (9) for controlling the quantity of said microporous egg-like sulphur trapping agent composition pellets having opening-porosity added to said layer-burnt burner.

A BRIEF DESCRIPTION OF THE DRAWINGS

DETAILED DESCRIPTION OF THE PRESENT INVENTION

Figure 1:
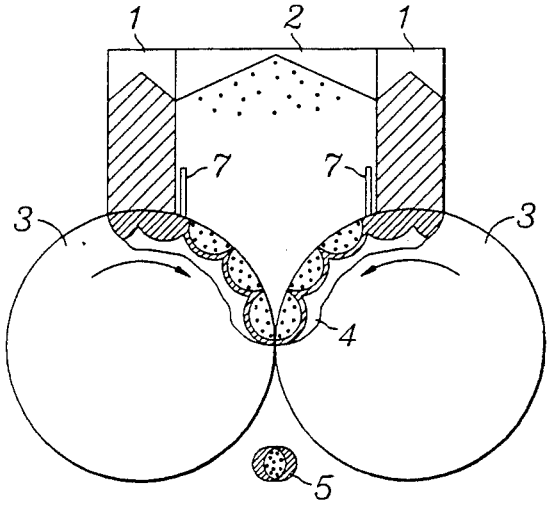
FIG. 1 is a schematic view of an improved roll briquetter.

When sulphur-containing coal which includes anthracite coal, bituminous coal, subbituminous coal and lignite is being burned, the sulphur in said coal is oxidized to produce sulphur dioxide. When said coal contains said calcium-containing material, the calcium compound in coal will decompose to produce CaO at high temperature, or said calcium-containing material is CaO. $SO_2$ emitted from burning sulphur-containing coal will react with CaO to produce $CaSO_3$ and/or $CaSO_4$ reversibly in the presence of a catalyst selected from the group consisting of inorganic compound of potassium. sodium, barium, manganese. tin and ferro under the elevated temperature:

$$S+O_2 \rightarrow SO_2 \quad (A)$$

$$CaO+SO_2 \rightleftharpoons CaSO_3 \quad (B)$$

$$CaO+SO_2+\tfrac{1}{2}O_2 \rightleftharpoons CaSO_4 \quad (C)$$

And the following reactions will also take place at the same time:

$$2CaO+2S+C \rightleftharpoons 2CaS+CO_2 \quad (D)$$

$$CaS+2O_2 \rightleftharpoons CaSO_4 \quad (E)$$

CaS is a very unstable intermediate, it will decompose very quickly under high temperature. On the other hand, when the sulphur-containing coal is being burned, a competition of oxidation between C and CaS will take place. As the reducing ability of CaS is weaker than that of C, most of the CaS will decompose under normal conditions. The sulphur produced during the decomposition of CaS will be oxidized to form $SO_2$.

In the prior arts, a calcum-containing sulphur trapping agent composition is only blended simply and directly with sulphur-containing coal and then the mixture is introduced to a burner for burning. Alternatively, the calcium-containing sulphur trapping agent composition and sulphur-containing coal are introduced simultaneously to a burner for burning. Because a small weight percent of sulphur trapping agent composition is used in burning, and the specific gravity of the composition used is larger than that of coal, the ratios of volume and total surface area of said composition are much smaller than those of coal. Additionally, the main sulphur trapping reactions are gas-solid reactions which take place on the surface of the solid. Therefore, the increasing of the total surface area of sulphur trapping agent composition is favorable for raising the conversion rate of $SO_2$ into $CaSO_3$ and/or $CaSO_4$. In general, the smaller the solid particle size, the larger the total area of the same quantity of solid. However, if the particle size of sulphur trapping agent composition is too small, the particle will be easily taken away by the air introduced to the burner or by the smoke produced in burning. Therefore, in the prior arts, the opportunity of $SO_2$ contacting sulphur trapping agent composition from burning is small and more $SO_2$ will emit to the atmosphere without contacting the sulphur trapping agent composition. In this case the conversion rate of $SO_2$ into $CaSO_3$ and/or $CaSO_4$ is not high and the coefficient of utilization of sulphur trapping agent composition is also low while the $SO_2$ content in the smoke is still high.

In order to raise the conversion rate of $SO_2$ into $CaSO_3$ and/or $CaSO_4$, it is necessary to increase the total surface area of the sulphur trapping agent composition on the one hand, and on the other hand it is also necessary to overcome the drawback of the sulphur trapping agent composition with too small particle size being taken away by the air introduced to the burner or by the smoke produced in burning.

In order to solve the above-mentioned problems the following techniques have been adopted in the present invention.

Pulverized combustible materials, such as coal, wood flour, combustible plant, charcoal, combustible synthetic materials or their wastes thereof, in an amount of about 1 percent to about 50 percent by weight, preferably in an amount of about 5 percent to about 30 percent by weight are mixed with pulverized sulphur trapping agent composition in an amount of about 99 percent to about 50 percent by weight, preferably in an amount of about 95 percent to about 70 percent by weight, and the admixture of the above components is ground to form powder in size of from about 30 mesh to about 60 mesh by means of a common grinder.

With an improved roll briquetter (FIG. 1 or FIG. 2), a briquette with a microporous surface layer of said admixture powder is prepared for burning.

When the briquette with a surface layer of said admixture powder is burned in a burner, the combustible material in said admixture on the surface of the briquette will be burned first, and a porous sulphur trapping agent composition layer will be formed on the surface of the briquette. If the combustible material in said admixture is sulphur-containing coal, nearly all the sulphur therein will be converted into $CaSO_3$ and/or $CaSO_4$. As the briquette continues to burn, $SO_2$ will be formed and emitted. All the $SO_2$ emitted has to pass through the porous layer of sulphur trapping agent composition formed on the briquette surface, so $SO_2$ will contact sulphur trapping agent composition sufficiently. In addition, reaction (E) will take place on the surface of the briquette to avoid the competing oxidation reaction between CaS and C, and CaS can be converted into $CaSO_4$ at a relatively high rate under such a condition. Therefore, when the briquette of the present invention is burned, the $SO_2$ content in smoke will be reduced greatly. The sulphur trapping agent composition is used in small amount owing to the high coefficient of utilization of said composition. In the briquette of the present invention, the atomic ratio of calcium to sulphur is in the range of from about 1.0 to about 2.0.

The above-mentioned admixture powder can also be shaped with a conventional roll briquetter to form an egg-like, microporous pellet having opening-porosity with a diameter of from about 8 mm to about 20 mm. The prepared pellets are covered on the surface of coal layer in a burner for burning.

When the burner filled with a layer of coal and a layer of the above prepared pellet is ignited for burning, the combustible material of the egg-like microporous pellets in the upper layer will be burned first, and a layer of porous and active sulphur trapping agent composition with opening-porosity is formed upon the layer of coal. When the lower layer of coal continues to burn, the sulphur dioxide formed has to pass through the porous and active upper layer of sulphur trapping agent composition. The total surface area of sulphur trapping agent composition is very large, because said composition has an opening-porosity, this enables $SO_2$ to have a good opportunity of contacting sulphur trapping agent composition and reaction (E) takes place on the upper layer of said composition to avoid competing oxidation reaction between C and CaS. So the conversion rate of $SO_2$ into $CaSO_3$ and/or $CaSO_4$ is raised, and the $SO_2$ content in smoke is reduced effectively. In the same manner, only a small amount of sulphur trapping agent composition is used owing to the high coefficient of utilization of said composition. In said burner, the atomic ratio of calcium in sulphur trapping agent composition to sulphur in the coal is within the range of from about 1.0 to about 2.0.

Figure 2:
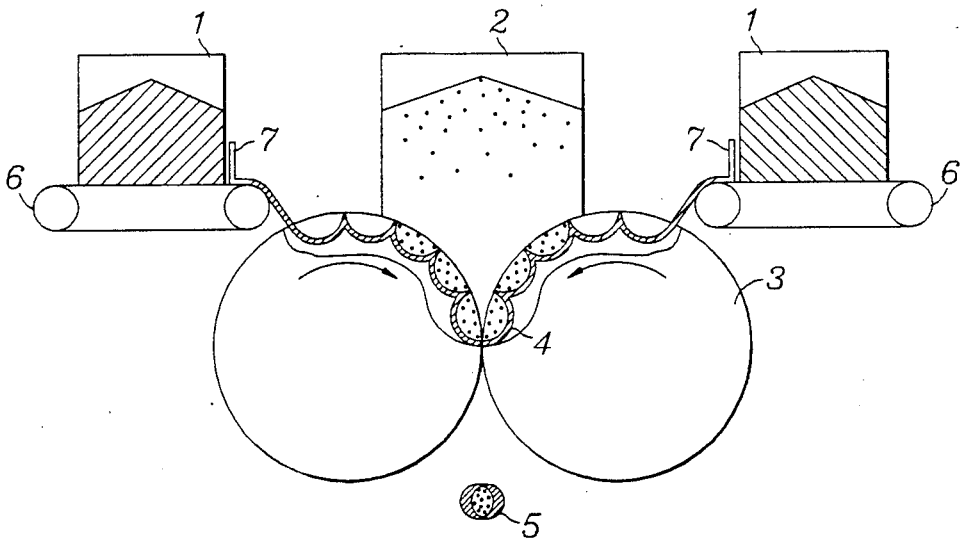
FIG. 2 is a schematic view of another improved roll briquetter.

According to this invention, the briquette wrapped up in a microporous surface layer of admixture powder of combustible material and sulphur trapping agent composition is prepared with an improved roll briquetter as shown in FIG. 1 and FIG. 2. In the conventional roll briquetter, at least one hopper (1) for said admixture powder is installed at the two sides of hopper (2) for pulverized coal. During the process of shaping briquettes, since hoppers (1) are at the two sides of hopper (2), when the roll is in operation, the admixture powder in hopper (1) will be added to ball sockets (4) located around the roll before the pulverized coal in hopper (2) and the briquette made thereof is wrapped up in a microporous surface layer of the admixture powder of sulphur trapping agent composition and combustible material. By controlling the valve (7) at the hopper (1), briquettes with optimum atomic ratios of calcium in sulphur trapping agent composition to sulphur in the pulverized coal can be made.

The process for preparing the briquette of the present invention comprises:

a. Screening raw coal: Raw coal is first screened in screening shop to remove lump coal with dimension larger than 8 mm and the undersize of the coal is used as the material for briquettes.

b. Feeding in proportion: According to the commerical demands for briquette products, various kinds of coal are adopted in a certain proportion as raw materials to form briquettes of various sulphur contents and thermal values.

c. Crashing: The coal prepared according to step (b) is crashed with drum crasher into particles, the diameter of the particle being less than 3 mm.

d. Mixing and kneading after the adding of a binder: Water is added to pulverized coal prepared according to step (c) and is adjusted to the amount of from about 10 weight percent to about 12 weight percent. If the water content of said pulverized coal is larger than 12 weight percent, it must be dried to keep its water content in an amount of from about 10 weight percent to about 12 weight percent, and then a binder solution, such as pulp waste, from about 5 weight percent to about 8 weight percent of the pulverized coal is added. The mixture is kneaded homogeneously and introduced to a vertical blending machine to improve its briquettability. After being kneaded, the mixture is added to hopper (2) of the improved roll briquetter as shown in FIG. 1 or FIG. 2 for further use.

Pulverized combustible materials, such as coal, wood flour, charcoal, etc., in an amount of from about 1 percent to about 50 percent by weight, preferably from about 5 percent to about 30 percent by weight are homogeneously mixed with pulverized sulphur trapping agent composition in an amount of from about 99 percent to about 50 percent by weight, preferably from about 95 percent to about 70 percent by weight. Said admixture is ground to powder with dimension of from about 30 mesh to about 60 mesh, and then is added to hopper (1) of the improved roll briquetter of the present invention as shown in FIG. 1 or FIG. 2 for further use.

e. Shaping: When the pulverized coal and the admixture powder of sulphur trapping agent composition and combustible material are ready, the briquetter is turned on. As hoppers (1) filled with said admixture are at the two sides of hopper (2) filled with the pulverized coal, when the roll is in operation, the admixture powder in hoppers (1) will be added to the ball sockets (4) before the pulverized coal in hopper (2) By controlling the valve (7) at hopper (1), the preliminary briquette wrapped up in a layer of sulphur trapping agent composition is made under the pressure of from about 250 $Kg/cm^2$ to about 550 $Kg/cm^2$.

f. Consolidating: The preliminary briquette is consolidated by conventional process to turn out briquette products.

Figure 3:
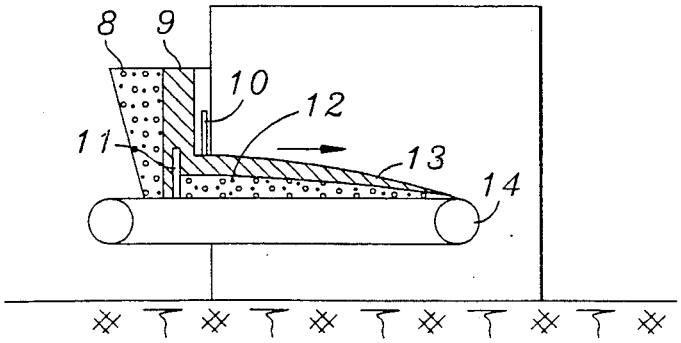
FIG. 3 is a schematic view of an improved layer-burnt burner.

The feeding device of the layer-burnt burner of the present invention is shown in FIG. 3. At the head of hopper (8) for pulverized coal, at least one hopper (9) for the prepared egg-like microporous sulphur trapping agent pellets is installed. This feeding device can guarantee the uniform addition of the egg-like microporous pellets to the covering of said coal in the layer-burnt burner. When the grate chain (14) of the layer-burnt burner is turned on, the pulverized coal in hopper (8) is added onto the grate-chain (14) first, and the egg-like, microporous sulphur trapping agent composition pellets are added onto the surface of the pulverized coal layer, forming an upper layer of microporous sulphur trapping agent composition pellets. By controlling the valve (10) at hopper (9), the amount of the feeding can be adjusted in atomic ratio of calcium in the upper layer of sulphur trapping agent pellets to sulphur in the lower layer of pulverized coal within the range of from about 1.0 to about 2.0.

The present invention will be further described in, but not limited by, the following examples.

EXAMPLE 1

This example is to provide further description of the preparation for briquettes of the present invention.

Mixed coal No. 1 sold in Beijing P. R. C. and Xinlong high sulphur-containing coal are used as raw coal for producing briquettes of the present invention.

The above kinds of coal are screened first to remove lump coal with diameter larger than 8 mm, and 45 percent by weight of the undersizes of the mixed coal No. 1 sold in Beijing are mixed homogeneously with 55 percent by weight of Xinlong high sulphur-containing coal to obtain blended coal with sulphur content of 2.7 weight percent for the test. Said blended coal is crashed into particle or powder with diameter smaller than 3 mm, and then a modified pulp waste as binder of 8 percent by weight is added. The above mixture with its water content adjusted to 11 percent of the total mixture by weight is kneaded homogeneously and then introduced to the hopper (2) of the improved roll briquetter as shown in FIG. 2.

An amount of 75 percent by weight of pulverized sulphur trapping agent composition and an amount of 25 percent by weight of pulverized blended coal are further admixed homogeneously. The obtained admixture is ground to about 40 mesh to about 50 mesh size and then introduced to the hopper (1) of the improved roll briquetter as shown in FIG. 2.

When said blended coal and the admixture powder of sulphur trapping agent composition and said blended coal are ready, the improved roll briquetter is turned on. When the roll is in operation, the admixture powder of sulphur trapping agent composition and said blended coal in hopper (1) is added to ball sockets (4) before said blended coal in hopper (2). By controlling the valves (7) at hoppers (1), the preliminary briquette can be produced with the atomic ratio of calcium in sulphur trapping agent composition to sulphur in said blended coal being 1.02. The pressure for shaping is 420 Kg/cm. Said preliminary briquette produced is consolidated by conventional process to obtain briquette products with a microporous surface layer of admixture powder of sulphur trapping agent composition and combustible material.

EXAMPLES 2–4

Briquettes with various atomic ratios of calcium to sulphur are made from the same raw materials and by the same process used in Example 1. The briquettes are put alternatively into an experimental furnace with diameter of 200 mm and height of 250 mm for burning. The chamber temperature of the furnace is about 1100° C. to about 1200° C.

The $SO_2$ content in smoke is measured by the standard method stipulated by The Chinese State Environmental Protection Bureau. The quantity of smoke from burning 1 kg of coal is measured according to "Thermodynamic Test Standards For Boiler" stipulated by the Chinese Machinery & Electronics Industry Ministry. The conversion rate of $SO_2$ is calculated according to the quantity of sulfate and sulfite found in the slag. The results are shown in Table I.

TABLE I

| | A.R.* of Ca to S in briquette | The quantity of smoke ($m^3$/Kg coal) | The $SO_2$ content in smoke (ppm) | The Conversion rate of $SO_2$ (%) |
|---|---|---|---|---|
| Example 2 | 1.02 | 9.08 | 770 | 63 |
| Example 3 | 1.33 | 9.04 | 459 | 78 |
| Example 4 | 1.98 | 9.12 | 161 | 92 |

Wherein, A.R.* means Atomic Ratio.

EXAMPLES 5–7

Three types of the same briquette used in Examples 2–4 are put alternatively into an industrial stoke-fired boiler (Mode KZL-1-7) for burning. The chamber temperature is about 1150° C. to about 1250° C. The $SO_2$ content in smoke the quantity of smoke from burning 1 kg of coal and the conversion rate of $SO_2$ are measured by the methods described in Examples 2–4. The results are shown in Table II.

TABLE II

| | A.R.* of Ca to S in briquette | The quantity of smoke ($m^3$/Kg coal) | The $SO_2$ content in smoke (ppm) | The Conversion rate of $SO_2$ (%) |
|---|---|---|---|---|
| Example 5 | 1.02 | 10.2 | 774 | 62 |
| Example 6 | 1.33 | 10.6 | 481 | 73 |
| Example 7 | 1.98 | 9.85 | 268 | 86 |

EXAMPLES 8–10

The coal and the sulphur trapping agent composition applied herein are the same as used in Example 1.

An amount of 25 weight percent of pulverized coal and an amount of 75 weight percent of pulverized sulphur trapping agent composition are admixed homogeneously and the obtained admixture is ground to powder with dimension from about 40 mesh to about 50 mesh. A modified pulp waste of 8 weight percent of said admixture is added as binder, and the mixture of said pulp waste and said admixture is kneaded and shaped with conventional roll briquetter to form egg-like, microporous sulphur trapping agent composition pellets having opening-porosity with diameter of 16 mm.

The above prepared egg-like microporous sulphur trapping agent composition pellets are added to the hopper (9) of the improved layer-burnt burner of the present invention as shown in FIG. 3. When the grate chain (14) is turned on, pulverized coal in the hopper (8) will be added onto the grate chain (14) first, and the egg-like, microporous sulphur trapping agent pellets in the hopper (9) are added onto the layer of the coal to form an upper layer of said pellets. By controlling the valve (10) at the hopper (9), the atomic ratios of calcium in the upper layer of sulphur trapping agent pellets to sulphur in the lower layer of coal are 1.05, 1.34 or 2.00 respectively. When the boiler is ignited, the $SO_2$ contents in the smoke, the quantities of the smoke from burning 1 kg coal and the conversion rates of $SO_2$ are measured by the methods adopted in Examples 2–4. The results are shown in Table III.

TABLE III

| | A.R.* of Ca to S | The quantity of smoke ($m^3$/kg coal) | The $SO_2$ content in smoke (ppm) | The Conversion rate of $SO_2$ (%) |
|---|---|---|---|---|
| Example 8 | 1.05 | 9.90 | 754 | 60.5 |

TABLE III-continued

| | A.R.* of Ca to S | The quantity of smoke ($m^3$/kg coal) | The $SO_2$ content in smoke (ppm) | The Conversion rate of $SO_2$ (%) |
|---|---|---|---|---|
| Example 9 | 1.34 | 10.5 | 522 | 71 |
| Example 10 | 2.00 | 10.3 | 330 | 82 |

COMPARATIVE EXAMPLES 1-4

A raw coal without any addition of sulphur trapping agent composition and briquettes prepared by the process of prior arts with atomic ratios of calcium to sulphur being 1.05, 1.41 or 2.04 are introduced alternatively into an experimental furnace as used in Example 2 for burning. The chamber temperature is about 1100° C. to about 1200° C. The $SO_2$ contents in the smoke, the quantities of smoke from burning 1 kg of coal and the conversion rates of $SO_2$ are measured by the same methods as used in Examples 2-4. The results are shown in Table IV.

TABLE IV

| Comparative Example | Kinds of coal | A.R. OF Ca to S | Quantity of smoke ($m^3$/kg coal) | $SO_2$ Cont. in smoke (ppm) | Conversion rate of $SO_2$ (%) |
|---|---|---|---|---|---|
| 1 | raw coal | 0 | 9.53 | 1826 | 7.9 |
| 2 | briquette | 1.05 | 9.40 | 1166 | 42 |
| 3 | briquette | 1.36 | 9.85 | 902 | 53 |
| 4 | briquette | 2.04 | 9.25 | 798 | 61 |

COMPARATIVE EXAMPLES 5-8

The four kinds of coal mentioned in Comparative Examples 1-4 are introduced alternatively into an industrial stoke-fired boiler (Mode KZL-1-7) for burning. The chamber temperature is about 1150° C. to about 1250° C. The $SO_2$ contents in the smoke, the quantities of smoke from burning 1 kg of coal and the conversion rates of $SO_2$ are measured by the same methods as used in Examples 2-4. The results are shown in Table V.

TABLE V

| Comparative Example | Kinds of coal | A.R. OF Ca to S | Quantity of smoke ($m^3$/kg coal) | $SO_2$ Cont. in smoke (ppm) | Conversion rate of $SO_2$ (%) |
|---|---|---|---|---|---|
| 5 | Raw coal | 0 | 10.9 | 1618 | 6.7 |
| 6 | Briquette | 1.05 | 9.75 | 1143 | 41 |
| 7 | Briquette | 1.41 | 10.5 | 891 | 50.5 |
| 8 | Briquette | 2.04 | 9.60 | 728 | 63 |

COMPARATIVE EXAMPLES 9-11

Pulverized coal and a pulverized sulphur trapping agent composition are mixed directly and homogeneously to prepare mixtures with atomic ratio of calcium to sulphur of 1.10 , 1.40 and 2.05. These mixtures are introduced alternatively to the improved layer-burnt burner used in Examples 8-10 for combustion. The $SO_2$ contents in the smoke, the quantities of smoke from burning 1 kg of coal and the conversion rates of $SO_2$ are measured by the same methods as used in Examples 2-4. The results are shown in Table VI.

TABLE VI

| Comparative Example | A. R. of Ca to S | Qan. of smoke ($m^3$/kg coal) | $SO_2$ Cont. in smoke (ppm) | Conv. rate of $SO_2$ (%) |
|---|---|---|---|---|
| 9 | 1.10 | 9.5 | 1353 | 32 |
| 10 | 1.42 | 9.95 | 1159 | 39 |
| 11 | 2.05 | 9.35 | 1092 | 46 |

What is claimed is:

1. A process for reducing sulphur dioxide emission from burning sulphur-containing coal including at least one of anthracite coal, bituminous coal, subbituminous coal or lignite, comprising:

(a) forming an admixture of a sulphur trapping agent composition in an amount of from about 99 to about 50 weight percent with a combustible material to obtain a powder of about 30 to about 60 mesh in size;

(b) Providing a supply of coal; and (c) preparing a coal briquette wherein the coal is wrapped up in a microporous surface layer of said admixture powder for burning.

2. A process as claimed in claim 1 wherein the coal briquette is formed by a roll briquettor.

3. The process of claim 1, wherein the sulphur trapping agent includes calcium and wherein the atomic ratio of calcium in said sulphur trapping agent composition to sulphur in the coal is from about 1.0 to about 2.0.

4. The process of claim 1 wherein said admixture contains the sulphur trapping agent composition in an amount of about 70 percent to about 95 percent by weight.

5. The process of claim 1 wherein said combustible material comprises selectively at least one of coal, wood flour, combustible plants, charcoal, combustible synthetic materials or their wastes.

6. The process of claim 2 wherein said briquette is prepared by adding said powder to the roll briquettor before adding the coal and then effecting a pressing.

7. The process of claim 1 including supplying the admixture from at least one hopper located at two sides of a hopper for the coal.

8. The process of claim 1 wherein, when said briquette is burned, a sulphur getting activity of the sulphur trapping agent composition in the surface layer is increased.

9. The process of claim 1 including supplying the coal in a pulverized form.

10. A process for reducing sulphur dioxide emission from burning sulphur-containing coal including at least one of anthracite coal, bituminous coal, subbituminous coal and lignite, comprising:

(a) preparing microporous pellets of an admixture powder of sulphur trapping agent composition and a combustible material;

(b) preparing a layer of coal; and (c) placing a layer of the pellets prepared in step (a) upon a surface of a coal layer.

11. The process of claim 10 wherein said pellets have an opening-porosity with a diameter of from about 8 mm to about 20 mm.

12. The process of claim 10 wherein the sulphur trapping agent includes calcium and wherein the atomic ratio of calcium in the sulphur trapping agent composition pellets to the sulphur in the coal is from about 1.0 to about 2.0.

13. The process of claim 10 wherein when the pellets layer is burned, a sulphur getting activity of the sulphur trapping agent composition is increased.

14. The process of claim 10 including supplying the coal in a pulverized form.

15. A process for reducing sulphur dioxide emission from burning sulphur-containing coal comprising:

(a) forming an admixture of a sulphur trapping agent composition in an amount of from about 99 to about 50 weight percent with a combustible material to obtain a powder of about 30 to about 60 mesh in size and wherein the sulphur trapping agent includes calcium and wherein the atomic ratio of calcium in said sulphur trapping agent composition to sulphur in the coal is from about 1.0 to about 2.0:

(b) Providing a supply of pulverized coal being at least one of anthracite coal, bituminous coal, subbituminous coal or lignite; and (c) locating the admixture on the coal to form a surface to the coal wherein the coal is formed with a microporous surface layer of said admixture powder for burning.

16. The process of claim 15 wherein said admixture contains the sulphur trapping agent composition in an amount of about 70 percent to about 95 percent by weight.

* * * * *